US005586499A

United States Patent [19]

Beaumont et al.

[11] Patent Number: 5,586,499

[45] Date of Patent: Dec. 24, 1996

[54] METHOD FOR ELIMINATING GEAR TRAIN BACKLASH IN A DRIVE FOR A MULTI-COLOR SHEET-FED PRINTING MACHINE HAVING FACE PRINTING AND PERFECTING MODES

[75] Inventors: Hendrikus Beaumont, Eupen, Belgium; Hanns-Otto Haas, Heusenstamm, Germany; Holger Wiese, Obertshausen, Germany; Bernd Lindner, Heusenstamm, Germany

[73] Assignee: MAN Roland Druckmaschinen AG, Germany

[21] Appl. No.: 536,938

[22] Filed: Sep. 29, 1995

[30] Foreign Application Priority Data

Sep. 30, 1994 [DE] Germany ..... 44 35 011.2

[51] Int. Cl.[6] ..... B41F 5/02

[52] U.S. Cl. ..... 101/211; 101/183; 101/229; 101/485

[58] Field of Search ..... 101/183, 184, 101/185, 181, 136, 137, 142, 177, 229, 230, 216, 231, 485, 484, 483, 486, 211; 74/409

[56] References Cited

U.S. PATENT DOCUMENTS 3,221,651 12/1965 Tagliasacchi ..... 101/183
3,511,179 5/1970 Breunig ..... 101/183

*Primary Examiner*—J. Reed Fisher
*Attorney, Agent, or Firm*—Leydig, Voit & Mayer, Ltd.

[57] ABSTRACT

A method for eliminating gear train backlash in the drive of a sheet-fed printing machines when changing the printing mode of the machine between face printing and perfecting or vice versa is disclosed. The printing machine has a gear train, a longitudinal drive shaft, and a plurality of input drives connecting the drive shaft to the gear train. At least one separation device is provided in the gear train, and at least one clutch is provided in the drive shaft. Releasing both the clutch and the separation device disconnects the printing machine into decoupled regions. After the relative position of those regions are adjusted for the new printing format, the new relative position is fixed by engaging the separation device. The segments of the longitudinal drive shaft is then adjusted to apply a torque to the gear train to eliminate backlash in the drive. The positioning can optionally be performed by the main drive motor or a separate positioning drive connected to the drive shaft.

17 Claims, 4 Drawing Sheets

METHOD FOR ELIMINATING GEAR TRAIN BACKLASH IN A DRIVE FOR A MULTI-COLOR SHEET-FED PRINTING MACHINE HAVING FACE PRINTING AND PERFECTING MODES

FIELD OF THE INVENTION

The invention relates generally to multi-color sheet-fed printing machines, and more particularly to a method for eliminating backlash in a drive mechanism for multi-color sheet-fed printing machines having a face printing mode and perfecting mode.

BACKGROUND OF THE INVENTION

A multi-color sheet-fed printing machine generally includes a plurality of printing units arranged such that each printing unit imprints a partial image of a predefined color on the sheet being printed. Typically, these printing units are connected to one another by a train of driving gears to achieve synchronization between the units. It is also common to drive the driving gears associated with the individual printing units with a single longitudinal drive shaft which is connected to the train of driving gears by a plurality of input drives. Thus, the drive of a printing machine of this type usually includes a drive shaft, a plurality of input drives, a train of driving gears, and a motor for rotating the drive shaft. One common problem encountered in this type of drive is backlash within the gear train. Such backlash can create irregularities in the print quality by causing the partial images imprinted by different printing units to be printed out of registry, resulting in poor print quality.

In order to eliminate these problems, it is known to take measures to eliminate backlash by applying a pre-stress to the drive. For example, a drive for multi-color, sheet-fed rotary printing machines in a series arrangement having at least two printing units is disclosed in German Patent Document DE 2,340,263. In this document, the disclosed drive has a longitudinal shaft and two worm gears which connect the longitudinal shaft to the train of gears of the individual printing units. To eliminate backlash, the longitudinal shaft is divided up and the individual parts are connected via an axially movable clutch. A hydraulic device can be employed to adjust the axially movable clutch to thereby tension the drive in the region of the worm gears to compensate for backlash in the gear train.

Further examples of pre-stressing the drive assembly to eliminate backlash can be found in Swiss Patent 570,266 and German Patent Document DE 2,354,541. In the former, a drive for a multi-color, sheet-fed rotary printing machine with series construction of the printing units is disclosed. This drive has a longitudinal shaft which is divided up into parts which are connected to one another by a torsion bar. A specially arranged gear is utilized to pre-stress this torsion bar in order to eliminate backlash in the drive. German Patent Document DE 2,354,541, on the other hand, discloses a drive for a multi-color, sheet-fed rotary printing machine having at least two printing units connected. In this case, a longitudinal shaft with associated worm gears for driving the individual printing units is pre-stressed axially in order to eliminate the backlash in the worm gears.

All of the above-described pre-stressing arrangements are limited in that they are either designed to act permanently on the drive of an associated printing unit, or, they are designed to work in printing machines where all of the individual printing units are permanently connected to one another.

There are, however, applications in which the printing units in a printing machine must be adjusted relative to each other from time to time. For example, some printing machines are designed to do both single-sided printing and double-sided printing. Single-sided printing is often called "face printing", and double-sided printing is often called "perfecting." In the double-sided printing mode, a sheet-turning device in the printing machine turns the sheet over after the first side is printed so that printing of the second side can be effected. Every time the printing mode of the machine is changed from the single-sided printing mode to the double-sided printing mode or vice versa, it is necessary to adjust a number of printing units in the printing machine relative to one another depending on the position of the sheet turning point and the sheet format being used. For this purpose, a separable connection of the drive is provided at a point in the train of gears. By releasing a clutch arranged at this turning point, the printing units ahead of the turning point can be rotated relative to the printing units behind the turning point and vice versa. This adjustment causes the backlash conditions between the separated groups of printing units to change. Because the backlash elimination arrangements discussed above are designed to compensate for fixed backlash conditions, they are not useful in a printing machine where the individual printing units are separated to adjust the printing mode from time to time. Since a continuous connection of the drive parts via a longitudinal shaft is not possible with the known arrangements for converting a printing machine from face printing to perfecting and vice versa, there is a need for providing a method for eliminating the backlash associated with such a machine.

OBJECTS OF THE INVENTION

In view of the foregoing, it is a general object of the invention to provide a method and apparatus for eliminating backlash in the drive of a multi-color sheet-fed printing machine which is designed for both single-sided and double-sided printing.

It is a related object to provide a method for eliminating gear train backlash which takes into account the load distributions on different parts of the printing machine. It is a further related object to provide a method which can be used to achieve desired torque distribution between the input drives of a printing machine.

It is another object of the invention to provide a method which permits a turning device to be inserted at any desired point in a printing machine without fear of producing different, uncompensated backlash conditions within the drive system.

It is another object to provide a method which is easily implemented and to provide an apparatus for implementing the method which is inexpensive.

SUMMARY OF THE INVENTION

The present invention achieves these objects and overcomes the problems associated with the prior art by providing a method for eliminating gear train backlash in a printing machine which is capable of both face printing and double-sided printing. More specifically, according to the method of the present invention, the printing machine is first operated to assume a predefined drive position for changing the printing mode. A clutch in the longitudinal shaft disposed between two input drives is then released to separate the drive shaft into two segments. After the position of the gear train is fixed, the gear train is separated into a first section and a second section by releasing a separation device disposed between the two sections. With the first section of the gear train maintained in the fixed position, the other section of the gear train is rotated to a new position associated with the new printing mode. The gear train is then reconnected by engaging the separation device, and the fixed section of the gear train is released for rotation. Subsequently, a first segment of the longitudinal shaft is rotated relative to the second segment of the shaft. The clutch is then engaged to reconnect the two segments of the longitudinal shaft with the two segments rotated relative to each other so as to apply a torque to compensate for backlash conditions in the gear train.

These and other features and advantages of the invention will be more readily apparent upon reading the following description of the preferred embodiment of the invention and upon reference to the accompanying drawings wherein:

DETAILED DESCRIPTION OF THE PREFERRED EMBODIMENT

Figure 1:
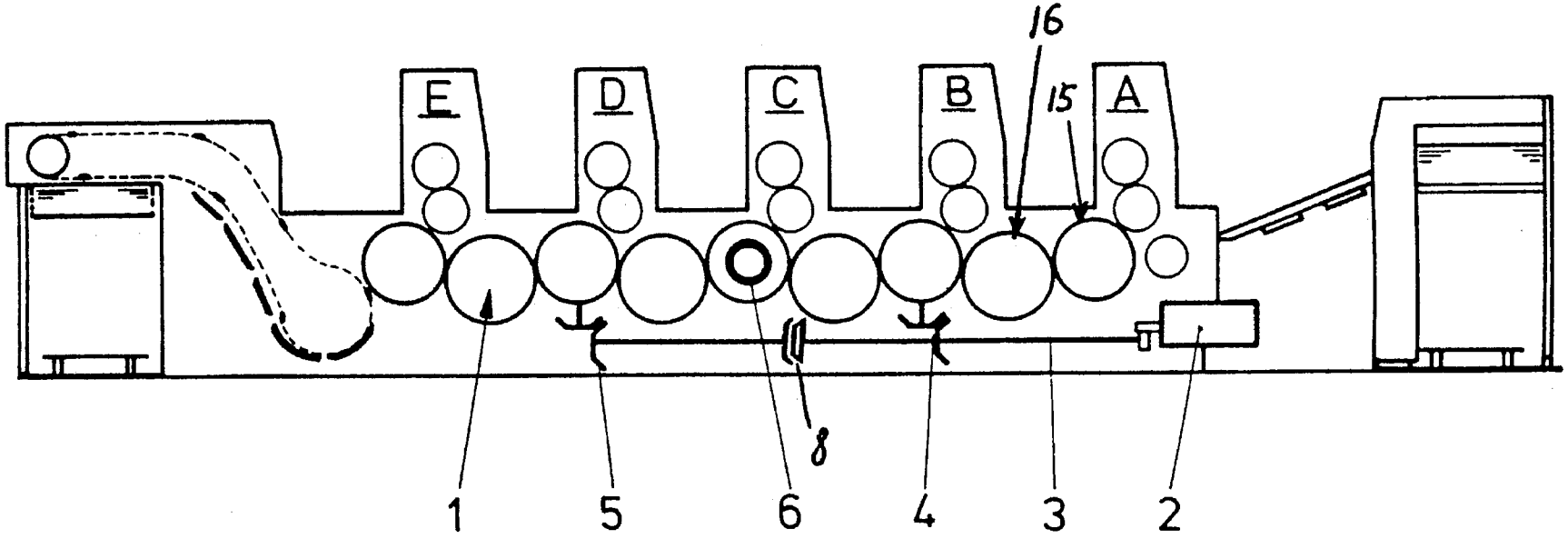
FIG. 1 is a schematic drawing of a multi-color, sheet-fed offset rotary printing machine constructed and operated in accordance with the teachings of the invention.

FIG. 1 shows generally a sheet-fed multi-color rotary printing machine constructed in accordance with the teaching of the present invention. The sheet-fed rotary printing machine has a gear train 1 interconnecting a plurality of printing units A–E which are driven by a longitudinal drive shaft 3. As shown in FIG. 1, the printing press includes a separation device 6 disposed in the gear train 1 for separating the gear train. A clutch 8 in the longitudinal drive shaft 3 divides the drive shaft 3 into two segments. Thus, the illustrated printing machine utilizes a clutch 8 in the longitudinal drive shaft 3 and a correspondingly located separation device 6 in the gear train 1 to permit the printing machine to be separated into two regions. Such separation permits the insertion of a sheet turning device into the train to convert the machine for double-sided printing. The relative rotational position of the gears in each region can then be adjusted to suit the printing mode of the machine. After the printing units are adjusted for the new printing mode, the relative position of the two separate segments of the drive shaft 3 can be adjusted to eliminate gear train backlash as described in detail below. Those skilled in the art will appreciated that it is also possible to use more than one clutch and separation device to divide the printing machine into more than two regions for independent adjustments thereof without departing from the scope or the spirit of the invention.

More specifically, each printing unit A–D in FIG. 1 is shown for illustrative purposes to have an impression cylinder 15 and a sheet-transfer drum 16. Driving gears, which are preferably spur gears, are disposed on the sides of the impression cylinders 15 and sheet-transfer drums 16. The driving gears are in mutual meshing engagement and, thus, form a gear train 1. The gear train 1 serves the functions of driving and synchronizing the motions of the printing units A–E.

The printing machine is driven by a main drive motor 2 via the longitudinal shaft 3. The required driving forces are branched off from the longitudinal shaft 3 to the gear train 1 via input drives 4 and 5. In the illustrated embodiment, two input drives 4 and 5 connect the drive shaft 3 to the driving gearwheels on the impression cylinders 15 of two different printing units B and D. A clutch 8 is provided in the drive shaft 3 between the two input drives 4 and 5. Preferably, a tapered clutch sold by Ortlinghaus, a German manufacturer, is employed. However, those skilled in the art will appreciate that any other suitable clutch could be employed as long as it is free of backlash.

As mentioned above, the illustrated printing press is suitable for performing either single-sided or double-sided printing. In order to change the printing mode from face (single-sided) printing to perfecting (double-sided printing), the gear train 1 which rigidly couples the printing units has to be disconnected. For this purpose, a separation device 6 is provided in the gear train 1 as shown in FIG. 1. The separation device 6 is shown here disposed on printing unit C, but those skilled in the art will appreciate that it could likewise be disposed on any other desired printing unit without departing from the scope or the spirit of the invention. The separation device 6 permits the printing units B and C to be separated in such a way that the impression cylinders 15 of the group of printing units A, B on one side of the separation point and the impression cylinders 15 of the group of printing units C–E on the other side of the separation point can be rotated relative to one another and can be coupled rigidly again by engaging the separation device 6. Preferably the separation device comprises a clutch mechanism for releasing the gears of a double gearwheel drive of the type disclosed in U.S. Pat. No. 5,265,528, which Patent is herein incorporated by reference.

Figure 2:
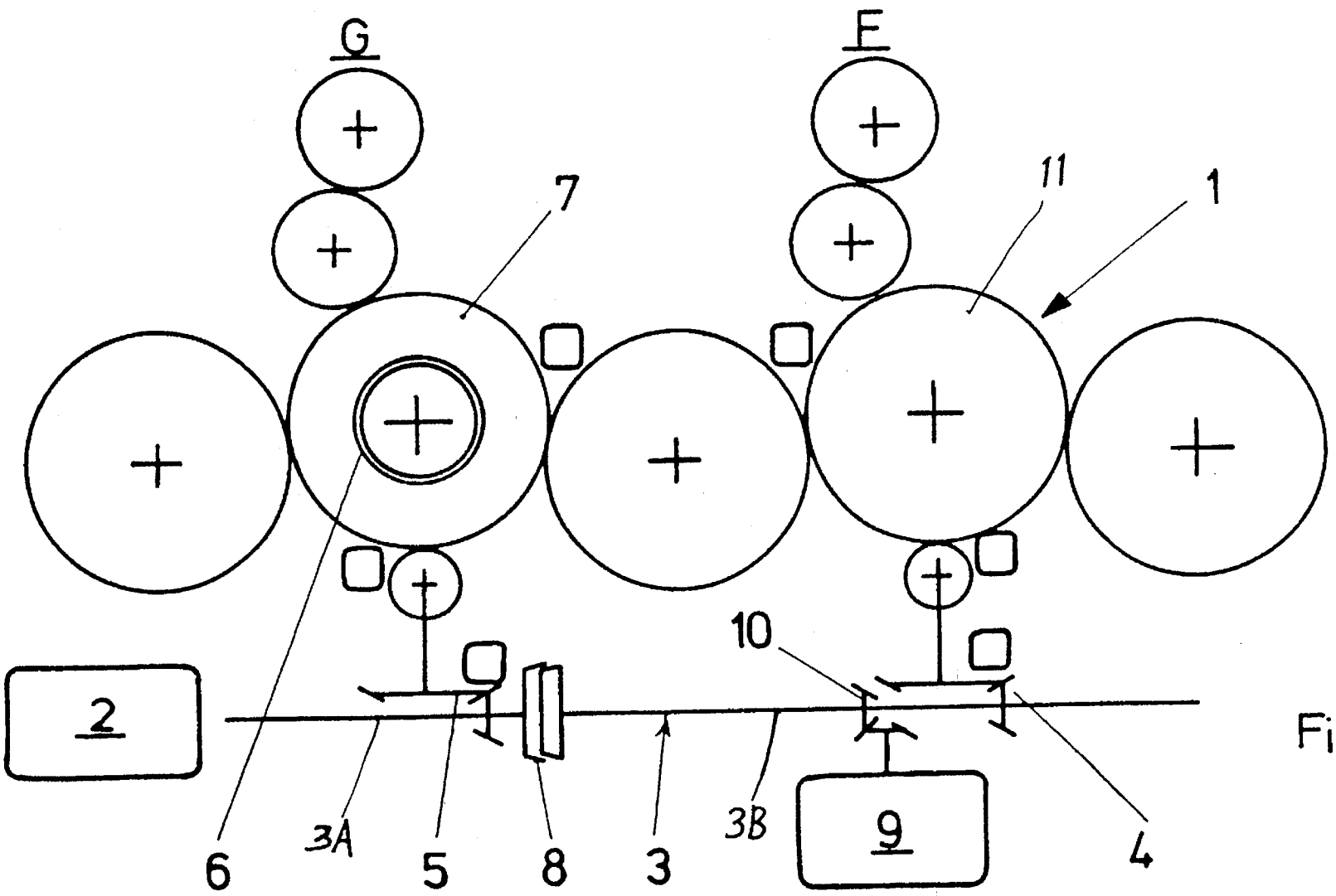
FIG. 2 is a schematic drawing of a section of the printing machine shown in FIG. 1.

Turning to FIG. 2, which for purposes of simplicity and clarity of illustration shows only two printing units G and F, the printing units are driven by a main motor 2 via a drive shaft 3, two input drives 4 and 5, and a gear train 1. Input drives 4 and 5 connect the drive shaft 3, through shaft segments 3A and 3B, to the gearwheels 11 and 7, of the printing units F and G respectively, which are mounted coaxially on the impression cylinders. The drive shaft 3 has a clutch 8 located between the input drives 4 and 5. Although the clutch 8 is illustrated in FIG. 2 as a cone clutch, those skilled in the art will appreciate that other types of clutches can also be used to divide the drive shaft into separable segments. A separation device 6 in the train 1 of gears is arranged on the driving gearwheel 7. The location of the separation device 6, thus, corresponds to that of the clutch 8, and is disposed between the input drives 4 and 5. The embodiment in FIG. 2 also has an optional positioning drive motor 9 connected via a gear 10 to the segment 3B of the drive shaft. The positioning drive 9 is provided as an alternative driving means for the adjustment of the gear 11 associated with printing unit F relative to the gear 7 associated with printing unit G. Because the positioning drive 9 is specifically designed for fine positioning motion, it is advantageous to set up the positioning drive 9 for automated precise adjustment of the relative position of the printing units F, G when the machine is being converted from single-sided printing to double-sided printing or vice versa. The relative positions of the separated units is dependant upon the paper format being processed as is known in the art. Although the positioning drive 9 is included in the illustrated embodiment, those skilled in the art will appreciate that the relative positional adjustments of the units F, G associated with changes in the printing mode can also be carried out by an appropriately controlled main drive motor 2.

In order to adjust the sheet-fed rotary printing machine for either face printing or perfecting, both the separation device 6 in the gear train 1 and the clutch 8 in the longitudinal shaft 3 are disengaged. The relative rotational positions of the printing units F, G are then adjusted by either the main drive motor 2 or the positioning drive 9. Subsequently, the gear train 1 is re-coupled by reengaging the separation device 6. The relative position of the printing units F, G is thus adjusted for the chosen operation or printing mode. To ensure precise sheet conveyance and alignment of the printed images, it is now necessary to adjust the relative position of the drive shaft segments 3A and 3B, which are connected respectively to input drives 4 and 5. Specifically, the relative positions of the shaft segments 3A and 3B are adjusted to insure that, when the machine is in operation, the torque distribution between input drives 4 and 5 is of a preferred ratio so as to pre-stress the drive of the printing machine to thereby eliminate gear train backlash. The desired torque distribution depends on the load conditions in different parts of the printing machine.

Figure 3:
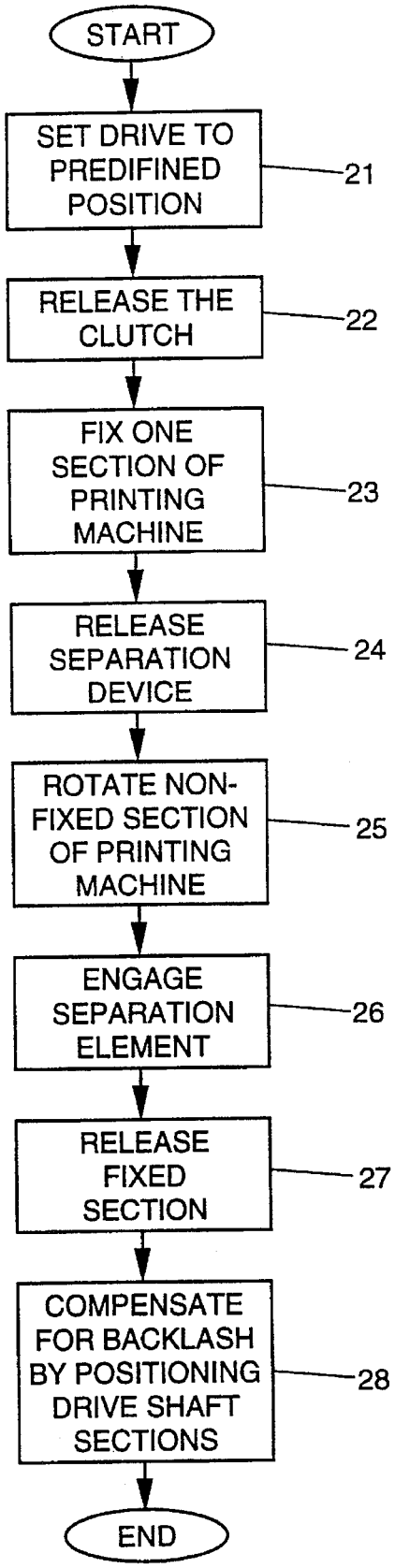
FIG. 3 is a flow chart showing the steps of the inventive method for eliminating gear train backlash in a dual mode printing machine.

FIG. 3 shows in flowchart form the steps of the inventive method for eliminating gear train backlash during the process of changing the printing modes of a printing machine. As shown in that Figure, in order to adjust the printing machine for a new printing mode, the machine is first operated to assume a predefined drive position for the changeover as shown in step 21. The clutch 8 in the longitudinal shaft 3 is then released to disengage the segments 3A and 3B of the drive shaft 3 as depicted in step 22. A region of the printing machine is then fixed (i.e., that distal to the clutch 8 or that proximal to the clutch 8) as in step 23. This fixing or braking function can be performed by the separation device 6 as disclosed in U.S. Pat. No. 5,265,528 or it can be performed pursuant to other methods known in the art without departing from the scope or the spirit of the invention. Which region of the machine is fixed depends on whether the main motor 2 or the positioning drive 9 is used as the driving means for adjusting the rotational positions of the gears of the printing units. If the main motor is used, the region of the printing machine connected to the drive shaft segment 3B (i.e., the segment proximal to the clutch 8 and the separating device 6) will be fixed. If the positioning drive 9 is used in this role, then the region connected to the drive shaft segment 3A which remains connected to the main motor 2 will be fixed.

In the next step 24, the separation device 6 is released to disconnect the gear train 1 such that the printing units F and G are completely decoupled. The non-fixed region is then rotated by the selected driving means (i.e., either the main motor 2 or the positioning drive 9) to adjust the relative rotational position of units F and G in accordance with the desired printing mode. After the relative rotational position of the non-fixed region and the fixed region is properly adjusted, the separation device 6 is engaged to reconnect the train 1 of gears as shown in step 26. The relative rotational positions of printing units F and G are, thus, fixed. The fixed region of the machine is then released from its fixed position as illustrated in step 27. In the following step 28, drive backlash is eliminated by first positioning the segments 3A and 3B of the drive shaft 3 relative to each other and then engaging the clutch 8 to apply a compensating torque to the gear train 1. This step of backlash elimination is preferably carried out automatically by proper control means such as a microprocessor based control circuit for controlling the rotational motions of the main drive motor 2 or the positioning drive 9. However, such adjustment can also be effected through operator control.

Compensation for gearwheel backlash in the drive is effected by rotating the segments 3A and 3B of the longitudinal drive shaft relative to one another with the clutch 8 disengaged. Depending on the driving means utilized, different procedures can be used to accomplish this positioning. For example, as shown in the upper portion of FIG. 4, when the main drive motor 2 is used for positioning and the proximal region of the machine adjacent to segment 3B of the shaft is fixed, there are four alternative approaches for positioning the shaft 3. In the first approach, the main drive motor is energized to move in the forward direction at creep speed up to a predefined clutch angle ALPHA (step 32). The main drive motor 2 is then stopped (step 33) and the clutch 8 of the longitudinal shaft 3 is engaged (step 34). Pursuant to the second approach, the main drive motor is energized to move in the forward direction at creep speed (step 35) and then the clutch 8 of the longitudinal shaft 3 is engaged at a predefined clutch angle ALPHA as the motor moves (step 36). In the third illustrative approach, the main drive motor 2 is energized to move in the reverse direction at creep speed up to a predefined clutch angle ALPHA (step 37). The main drive motor 2 is then stopped (step 38) and the clutch 8 in the longitudinal shaft 3 is engaged (step 39). In the fourth alternative approach, the main drive motor 2 is energized to move in the reverse direction at creep speed (step 40) and the clutch 8 of the longitudinal shaft 3 is then engaged at a predefined clutch angle ALPHA as the motor moves (step 41).

Figure 4:
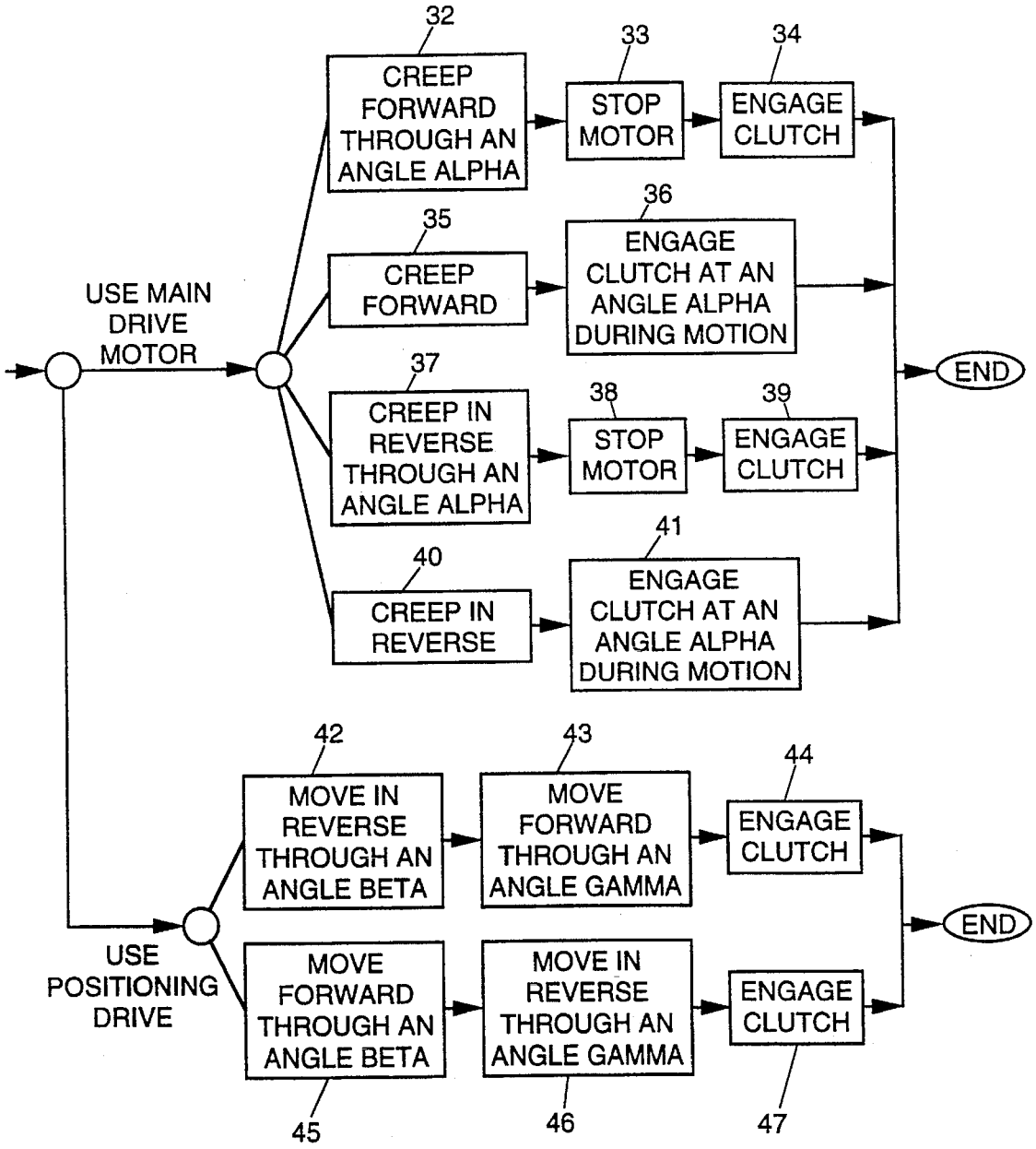
FIG. 4 is a flow chart showing the steps for adjusting the relative positions of different segments of the drive shaft for eliminating gear train backlash.

Still referring to FIG. 4 and also to FIG. 2, when the positioning drive 9 is used for positioning and the region of the machine adjacent to segment 3A of the longitudinal shaft 3 is fixed, there are two alternative approaches to adjust for gear train backlash. For example, in the first approach, the positioning drive 9 is energized to move in the reverse direction through a predefined machine angle BETA (step 42). The positioning drive is then energized to move in the forward direction through a predefined machine angle GAMMA (step 43). Finally, the clutch 8 in the longitudinal shaft 3 (step 44) is engaged. In the last alternative approach, the positioning drive 9 is driven in the forward direction through a predefined machine angle BETA (step 45). The positioning drive is then driven in the reverse direction through a predefined machine angle GAMMA (step 46). Finally, the clutch 8 in the drive shaft is engaged (step 47).

By reconnecting the segments of the longitudinal shaft 3 with one segment torqued relative to the other, the backlash conditions in the drive parts are compensated for and the machine is configured to produce accurately aligned images. Because the method of the invention can be used to eliminate gearwheel backlash after adjustment of the printing units, it is an advantage of this invention that a sheet turning device can be inserted at any desired point in the machine without the risk of introducing uncompensated gear train backlash. Additionally, the torque ratio at the input gears connected to the drive shaft can always be kept at a desired constant value. Furthermore, if desired, the method of the invention can be executed automatically as the final steps of an automated printing mode change sequence. Finally, the apparatus for implementing the method according to the invention is of very simple design since only a commercially available clutch is required for each segment of the longitudinal shaft.

As described above, either the main drive motor 2 or the positioning drive 9 can be used for backlash compensation.

Because the main drive motor 2 is used in the subsequent printing operation for driving the printing machine, using the main drive motor 2 in the backlash compensation procedure has the advantage that loads due to the machine movement are taken into account directly as part of the backlash conditions. In particular, it is possible to take different drive loads into account by engaging the clutch 8 during the motion of the main drive motor 2, as in the second and fourth approaches described above. For this purpose, the movement of the main drive motor 2 can be carried out at different speeds. The proper speed can be chosen by referring to well known characteristic curves associated with the machine. Different torque ratios and drive load distributions on the different input drives 4, 5 can thus be achieved.

On the other hand, using the positioning drive 9 is a convenient way to accomplish backlash compensation when changing printing modes. The positioning drive 9 is specifically designed to carry out angular motions in fine steps. The main motor 2, in contrast, is generally designed to drive the printing machine at relative high speed during the printing operations. Thus, using the positioning drive 9 which is designed for precise control avoids the expense of modifying the main drive motor 2 with additional control circuitry to improve its control accuracy when making minor positional adjustments.

In general, the predefined machine angles BETA and GAMMA in the last two procedures described above are relatively small, commonly on the order of one degree or less and can easily be determined. Specifically, after the machine is rotated through the angle BETA, the gears in the drive are securely engaged with one another (i.e., a contact of all the tooth flanks in the drive is achieved). However, since the two segments of the drive shaft are separated by the clutch 8 during this positioning step, only one part of the shaft 3B is moved directly by the positioning drive 9 while the other portion 3A is moved indirectly through its connection to the gear train 1. As a result, the tooth flanks in contact after this positioning step is completed are not those tooth flanks that will be in contact during the printing operation. This state of engagement can be corrected by a return rotary movement through an angle GAMMA. The contact of the operating flanks, (i.e., the tooth flanks used during printing operation), is produced by rotating the gear train 1 through the angle GAMMA in the direction opposite to the rotation through the angle BETA. Typically, the angle GAMMA is smaller than the angle BETA.

This approach permits a user to achieve virtually any desired torque distribution between the input drives 4 and 5 by positioning the drive at different values of the angle GAMMA. In an automated printing mode change process, the angle GAMMA will be selected automatically according to the anticipated machine loading. This machine loading depends on the configuration of the multi-color, sheet-fed printing machine used. For example, the machine may have additional components present, such as varnishing devices which would effect this loading. Also, in certain applications not all of the printing units A–F are used. Depending on the number of printing units employed and on whether additional components such as varnishing units are employed, the angle GAMMA is appropriately selected from a family of characteristic curves. Normally, however, one predefined value of the angle GAMMA is sufficient for a given mode of operation, and often the same angle GAMMA can be used when converting from face printing to perfecting operations or vice versa.

To summarize briefly, in employing the backlash elimination method described above, it is necessary to provide a controllable drive, such as the main motor drive 2 or the positioning drive 9, to a clutch 8 in the longitudinal shaft 3. The two shaft segments 3A and 3B separated by the clutch can thus be rotated relative to each other by means of the controllable drive in any direction at any angle to eliminate gear train backlash before the clutch 8 is engaged again. The six alternative approaches described above should be viewed as merely special applications of this principle. Because the method of the invention can be used to eliminate gear train backlash after adjustment of the printing units, it is an advantage of this invention that a sheet turning device can be inserted at any desired point in the machine without the risk of introducing backlash into the drive. The method of the invention can be executed automatically as the final steps of an automated printing mode change sequence. The embodiments described above have only two input drives and, thus, require only one clutch and one separation device for decoupling the two input drives. However, those skilled in the art will appreciate that the inventive method can also be used with drives having more than two input drives. For example, if three input drives are employed, then two clutches in the drive shaft and two separation devices correspondingly located in the gear train can be provided for decoupling the printing machine into three sections. The method can then be applied as described above. The only factor remaining to be taken into account in the procedure is the orientation within the drive which depends on where the separation devices in the gear train and the clutches in the longitudinal shaft are respectively arranged.

It will be appreciated now that a method for eliminating gear train backlash in the drive of a multi-color sheet-fed printing machine after the printing machine has been adjusted from face printing to perfecting or vice versa has been provided. At least one separation device is provided in the gear train, and at least one clutch is provided in the longitudinal shaft of the drive. By disengaging the separation device and the clutch, the printing machine can be divided into separate regions which can be adjusted independently to achieve proper alignment of the units for performing a desired printing operation on a selected paper format. After the regions of the printing machine are adjusted, backlash compensation is achieved by adjusting the relative position of the segments of drive shaft to apply a compensating torque to the gear train.

Although the invention has been described in connection with certain embodiments, it will be understood that there is no intent to in any way limit the invention to those embodiments. On the contrary, the intent is to cover all alternative, modifications and equivalents included within the spirit and scope of the invention as defined by the appended claims.

What is claimed is:

1. A method for eliminating gear train backlash in the drive of a sheet-fed printing machine when changing the printing mode of the machine between face printing and perfecting or vice versa, the printing machine having a gear train, a longitudinal drive shaft, and at least two input drives for connecting the longitudinal drive shaft to the gear train, the method comprising the steps of:

operating the printing machine to assume a predefined drive position for changing the printing mode;

releasing a clutch in the longitudinal shaft disposed between the at least two input drives to separate the drive shaft into two segments;

fixing the position of the gear train;

separating the gear train into a first section and a second section by releasing a separation device disposed between the two sections of the gear train;

rotating the second section of the gear train to a new position associated with the new printing mode while maintaining the first section of the gear train in the fixed position;

reconnecting the first and second sections of the gear train by engaging the separation device;

releasing the first section of the gear train for rotation;

rotating a first segment of the longitudinal shaft relative to a second segment of the longitudinal shaft; and engaging the clutch in the longitudinal shaft to reconnect the two segments of the drive shaft with the first segment rotated relative to the second segment to apply a torque to compensate for backlash conditions in the gear train.

2. A method as defined in claim 1 wherein the relative positions of the first and second segments of the drive shaft are selected according to the anticipated loading of the printing machine in the new printing mode.

3. A method as defined in claim 2 wherein the relative positions of the first and second segments of the drive shaft are selected according to the desired torque distribution between the input drives.

4. A method for eliminating drive backlash in the drive of a sheet-fed printing machine when changing the printing mode of the machine between face printing and perfecting or vice versa, the printing machine having a gear train, a longitudinal drive shaft connected to a main drive motor, and at least two input drives for connecting the longitudinal drive shaft to the gear train, the method comprising the steps of:

operating the printing machine to assume a predefined drive position for changing the printing mode;

releasing a clutch in the longitudinal shaft disposed between the at least two input drives to separate the drive shaft into two segments, a first segment being associated with the main drive motor and a second segment being separated from the main drive motor by the clutch;

fixing the position of the gear train connected to the second segment of the drive shaft;

separating the gear train into a first section and a second section by releasing a separation device disposed between the two sections of the gear train;

energizing the main drive motor to rotate the first section of the gear train to a new position associated with the new printing mode while maintaining the second section in the fixed position;

reconnecting the first and second sections of the gear train by engaging the separation device;

releasing the second section of the gear train for rotation;

rotating the first segment of the longitudinal shaft relative to the second segment of the longitudinal shaft by driving the main drive motor at creep speed; and engaging the clutch to reconnect the first and second segments of the longitudinal shaft with the first segment rotated relative to the second segment of the shaft to apply a torque to compensate for backlash conditions in the gear train.

5. A method as defined in claim 4 wherein the relative positions of the first and second segments of the drive shaft are selected according to the anticipated loading of the printing machine and the desired torque distribution between the input drives for the new printing mode.

6. A method as defined in claim 4 wherein the main drive motor is energized at creep speed in a predefined rotational direction up to a predefined clutch angle and then stopped.

7. A method as defined in claim 6 wherein the predefined direction is the forward direction.

8. A method as defined in claim 6 wherein the predefined direction is the reverse direction.

9. A method as defined in claim 4 wherein the main drive motor is energized at creep speed in a predefined rotational direction, and the clutch is engaged at a predefined clutch angle during the movement of the main drive motor.

10. A method as defined in claim 9 wherein the predefined direction is the forward direction.

11. A method as defined in claim 9 wherein the predefined direction is the reverse direction.

12. A method for eliminating drive backlash in the drive of a sheet-fed printing machine when changing the printing mode of the machine between face printing and perfecting or vice versa, the printing machine having a gear train, a longitudinal drive shaft connected to a main drive motor, and at least two input drives for connecting the longitudinal drive shaft to the gear train, the method comprising the steps of:

operating the printing machine to assume a predefined drive position for changing the printing mode;

releasing a clutch in the longitudinal shaft disposed between the at least two input drives to separate the drive shaft into two segments, a first segment being associated with the main drive motor and a second segment being separated from the main drive motor by the clutch;

fixing the position of the gear train connected to the first segment of the drive shaft;

separating the gear train into a first section and a second section by releasing a separation device disposed between the two sections of the gear train;

energizing a positioning drive connected to the second segment of the drive shaft to rotate the second section of the gear train to a new position associated with the new printing mode while maintaining the first section of the gear train in the fixed position;

reconnecting the first and second sections of the gear train by engaging the separation device;

releasing the first section of the gear train for rotation;

rotating the second segment of the drive shaft relative to the first segment of the drive shaft by energizing the positioning drive; and engaging the clutch to reconnect the first and second segments of the longitudinal shaft with the second segment rotated relative to the first segment of the shaft to apply a torque to compensate for backlash conditions in the gear train.

13. A method as defined in claim 12 wherein the relative positions of the first and second segments of the drive shaft are selected according to the anticipated loading of the printing machine and the desired torque distribution between the input drives for the new printing mode.

14. A method as defined in claim 12 wherein the positioning drive rotates the second segment of the drive shaft in a first direction through a first predefined machine angle, then in the direction opposite to the first direction through a second predefined machine angle.

15. A method as defined in 14 wherein the first direction is the reverse direction.

16. A method as defined in 14 wherein the first direction in the forward direction.

17. A method as defined in claim 14 wherein the second predefined machine angle is smaller than the first predefined machine angle.

* * * * *